US012558592B2

(12) United States Patent
Liu et al.

(10) Patent No.: US 12,558,592 B2
(45) Date of Patent: Feb. 24, 2026

(54) TREADMILL CAPABLE OF ADJUSTING SLOPE RISING AND FALLING BY SCREW ROD

(71) Applicant: Shenzhen Yile Dynamic Technology Co., LTD, Guangdong (CN)

(72) Inventors: Ren Liu, Guangdong (CN); Jinsong Fan, Guangdong (CN)

(73) Assignee: Shenzhen Yile Dynamic Technology Co., LTD, Shenzhen (CN)

( * ) Notice: Subject to any disclaimer, the term of this patent is extended or adjusted under 35 U.S.C. 154(b) by 171 days.

(21) Appl. No.: 18/487,037

(22) Filed: Oct. 13, 2023

(65) Prior Publication Data

US 2025/0082987 A1 Mar. 13, 2025

(30) Foreign Application Priority Data

Sep. 9, 2023 (CN) ..... 202322448478.8

(51) Int. Cl.
*A63B 22/02* (2006.01)
*A63B 22/00* (2006.01)

(52) U.S. Cl.
CPC ..... *A63B 22/02* (2013.01); *A63B 22/0023* (2013.01); *A63B 22/0046* (2013.01); *A63B 2225/09* (2013.01); *A63B 2225/093* (2013.01)

(58) Field of Classification Search
CPC . A63B 22/0023; A63B 22/0046; A63B 22/02; A63B 2225/09; A63B 2225/093
See application file for complete search history.

(56) References Cited

U.S. PATENT DOCUMENTS

| | | | | |
|---|---|---|---|---|
| 4,635,928 | A * | 1/1987 | Ogden | A63B 22/0257 482/54 |
| 4,759,540 | A * | 7/1988 | Yu | A63B 22/0023 482/901 |
| 5,921,893 | A | 7/1999 | Hurt | |
| 7,789,807 | B1 * | 9/2010 | Wang | A63B 22/0235 482/52 |
| 7,819,779 | B2 * | 10/2010 | Chang | A63B 22/0056 482/52 |
| 9,352,185 | B2 | 5/2016 | Hendrickson et al. | |
| 11,612,783 | B2 | 3/2023 | Kueker et al. | |
| 2004/0171465 | A1 | 9/2004 | Hald et al. | |
| 2007/0225126 | A1 * | 9/2007 | Yoo | A63B 22/0235 482/54 |
| 2020/0254300 | A1 * | 8/2020 | Khilmanovich | A63B 22/0023 |
| 2025/0082985 | A1 * | 3/2025 | Liu | A63B 22/0235 |
| 2025/0082986 | A1 * | 3/2025 | Liu | A63B 22/02 |
| 2025/0229124 | A1 * | 7/2025 | Hu | A63B 22/0235 |

* cited by examiner

*Primary Examiner* — Megan Anderson

(57) ABSTRACT

Provided is a treadmill capable of adjusting slope rising and falling by a screw rod, including: a running platform; a running frame, configured to bear the running platform; a lifting frame, arranged below the running frame, configured to adjust the slope of the treadmill and including a side arm, one end of the side arm being pivoted to the running frame; and a driving mechanism, including a lead screw, the lead screw being in sleeving connection with a screw sleeve in a matching manner, and an outer side of the screw sleeve being rotatably connected to a supporting arm. The driving mechanism is arranged between the running frame and the lifting frame; the screw sleeve is driven by rotating the lead screw, so that the screw sleeve reciprocates on the lead screw; and the lifting frame is driven by the supporting arm to adjust the slope of the treadmill.

8 Claims, 3 Drawing Sheets

TREADMILL CAPABLE OF ADJUSTING SLOPE RISING AND FALLING BY SCREW ROD

CROSS REFERENCE

This application claims priority benefits to Chinese Patent Application No. 202322448478.8, filed Sep. 9, 2023, the contents of which are incorporated herein by reference.

TECHNICAL FIELD

This application relates to the technical field of treadmills, and in particular to a treadmill capable of adjusting slope rising and falling by a screw rod.

BACKGROUND

Now people are becoming more and more lazy, and sub-health is becoming more and more serious, which will seriously affect our health for a long time. In fitness exercises, running is a better way of exercise, and a treadmill is good fitness equipment to realize running indoors. Body builders hope that the treadmill can simulate various road conditions, so the slope adjusting function can become the standard of most treadmills. Most of existing slope adjusting functions are driven by a motor, and the shortcomings are that the motor and the matched assemblies are high in cost, resulting in the increasing overall cost of the treadmill. In addition, since the mechanical and circuit structures of the electrical lifting structure are relatively complicated, the later maintenance and repair costs are also relatively high.

SUMMARY

An objective of the present invention is to provide a treadmill capable of adjusting slope rising and falling by a screw rod, thereby overcoming the shortcomings in the prior art.

To achieve the above objective, the present invention provides the following technical

Solution a treadmill capable of adjusting slope rising and falling by a screw rod includes:

a running platform;

a running frame, configured to bear the running platform;

a lifting frame, arranged below the running frame and including a side arm, one end of the side arm being pivoted to the running frame;

a driving mechanism, including a lead screw, the lead screw being in sleeving connection with a screw sleeve in a matching manner, and an outer side of the screw sleeve being rotatably connected to a supporting arm, characterized in that the driving mechanism is arranged between the running frame and the lifting frame, the screw sleeve is driven by rotating the lead screw to move on the lead screw, and the supporting arm is driven to drive the lifting frame to adjust the slope of the treadmill.

In some embodiments, the running frame includes a first border and a second border; and the side arm includes a first side arm and a second side arm, one end of the first side arm being pivoted to the first border, and one end of the second side arm being pivoted to the second border.

In some embodiments, the running frame is provided with a pivoting base, and the first side arm and the second arm are jointly pivoted to the pivoting base.

In some embodiments, the lead screw includes a forward thread section and a reverse thread section, the forward thread section is in sleeving connection with a first screw sleeve, and the reverse thread section is in sleeving connection with a second screw sleeve; and the supporting arm includes a first supporting arm and a second supporting arm, the first supporting arm is pivoted to the first screw sleeve, and the second supporting arm is pivoted to the second screw sleeve.

In some embodiments, the lead screw is rotatably arranged between the first border and the second border, the free end of the first supporting arm is pivoted to the first side arm, and the free end of the second supporting arm is pivoted to the second side arm.

In some embodiments, a cross beam is arranged between the first side arm and the second side arm, the lead screw is rotatably arranged between the first border and the second border, and the free end of the first supporting arm and the free end of the second supporting arm are pivoted to the cross beam.

In some embodiments, the lead screw is rotatably arranged between the first side arm and the second side arm, the free end of the first supporting arm is pivoted to the first border, and the free end of the second supporting arm is pivoted to the second border.

In some embodiments, the lead screw includes a thread section, the thread section is in sleeving connection with a screw sleeve, and the supporting arm is pivoted to the screw sleeve.

In some embodiments, a cross beam is arranged between the first side arm and the second side arm, the lead screw is rotatably arranged between the first border and the second border, and the free end of the supporting arm is pivoted to the cross beam.

In some embodiments, a cross frame is arranged between the first border and the second border, the lead screw is rotatably arranged between the first side arm and the second side arm, and the free end of the supporting arm is pivoted to the cross frame.

In some embodiments, the free end of the supporting arm is rotatably connected to a rotating shaft base through a second rotating shaft, and the rotating shaft base is rotatably connected to the lifting frame or the running frame through a first rotating shaft; and the first rotating shaft and the second rotating shaft are perpendicular to each other.

In some embodiments, a crank is arranged at a first end of the lead screw.

In some embodiments, a moving wheel is arranged at an end part of the side arm.

In some embodiments, several bottom feet are arranged at the bottom of the running frame.

Compared with the prior art, the present application has the following advantages:

the lifting structure of the present application adopts a manually driven mechanical structure and is simple in structure and low in cost, and the later maintenance and repair costs are lower than those of an electric lifting structure; secondly, the selling price can be reduced on the premise of reducing the manufacturing cost; and the driving mechanism in the present application drives the treadmill in a cooperative manner of the lead screw and the screw sleeve to adjust the slope, and the cooperation between the lead screw and the screw sleeve in the present application has a self-locking ability, so that the treadmill is safer during use.

BRIEF DESCRIPTION OF THE DRAWINGS

The accompany drawings constituting a part of this application provide further understanding of the present invention. The schematic embodiments of the present invention and description thereof are intended to be illustrative of the present invention and do not constitute an undue limitation of the present invention. In the drawings.

Figure 1:
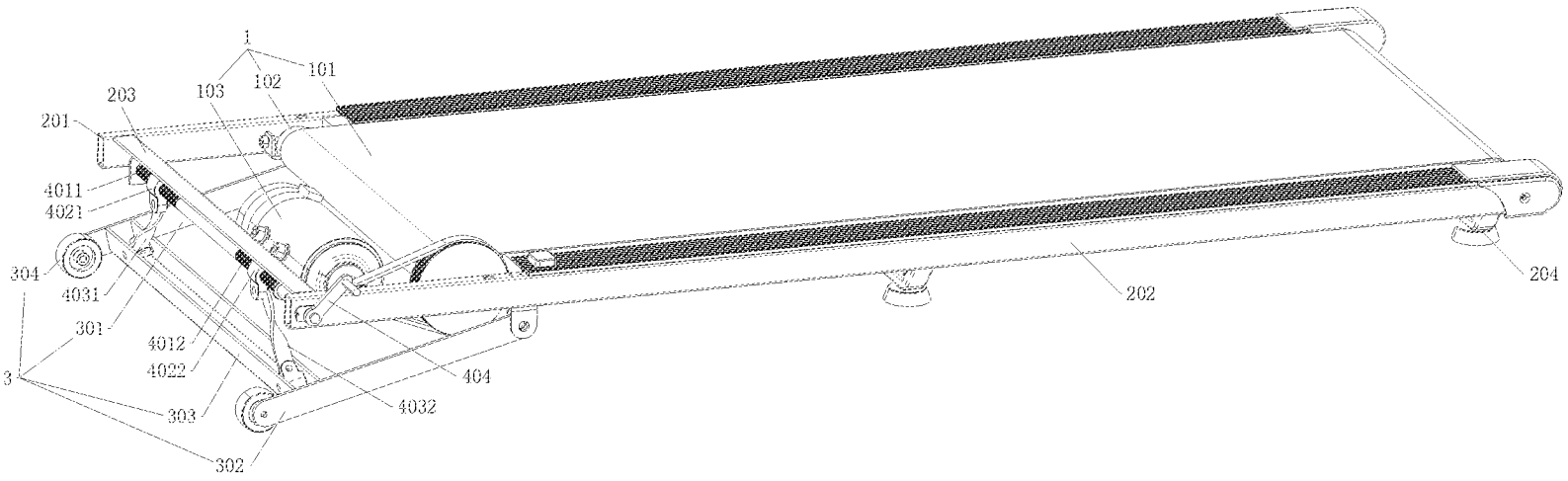
FIG. 1 is a schematic diagram of an overall structure according to an embodiment of the present invention.

Description of reference numerals: 1-running platform; 101-running belt; 102-roller; 103-running motor; 2-running frame; 201-first border; 202-second border; 203-cross frame; 204-bottom foot; 3-lifting frame; 301-first side arm; 302-second side arm; 303-cross beam; 304-moving wheel; 4-driving mechanism; 401-lead screw; 4011-forward thread section; 4012-reverse thread section; 4013-thread section; 402-screw sleeve; 4021-first screw sleeve; 4022-second screw sleeve; 403-supporting arm; 4031-first supporting arm; 4032-second supporting arm; 404-crank; 405-rotating shaft base.

DETAILED DESCRIPTION OF THE EMBODIMENTS

The present invention will be described in detail below with reference to the accompanying drawings and in conjunction with embodiments. Various examples are provided by way of interpretation of the present invention and are not intended to limit the present invention. Indeed, it will be apparent to those skilled in the art that modifications and variations may be made in the present invention without departing from the scope or spirit of the present invention. For example, features shown or described as part of one embodiment may be used in another embodiment to produce yet another embodiment. Therefore, it is desirable that the present invention includes such modifications and variations falling within the scope of the appended claims and their equivalents.

In the description of the present invention, the terms "longitudinal", "transverse", "up", "down", "front", "back", "left", "right", "vertical", "horizontal", "top", "bottom" and the like denote orientation or positional relationships based on those shown in the drawings and are intended for case of description only and not to require that the present invention is necessarily constructed and operated in a particular orientation and therefore cannot be construed as limiting to the present invention. The terms "connection", "connect" and "set" used in the present invention should be understood in a broad sense, for example, which may refer to a fixed connection or a detachable connection; which may refer to a direct connection or an indirect connection through intermediate components; which may refer to a wired electrical connection, a radio connection, or a wireless communication signal connection, and the specific meanings of the above terms may be understood by those of ordinary skill in the art according to a specific situation.

One or more examples of the present invention are shown in the accompanying drawings. The detailed description uses numeric and letter marks to refer to features in the drawings. Similar or like reference signs in the drawings and descriptions have been used to refer to similar or like parts of the present invention. As used herein, the terms "first", "second" and "third" and the like are used interchangeably to distinguish one member from another and are not intended to denote the location or importance of individual members.

Figure 2:
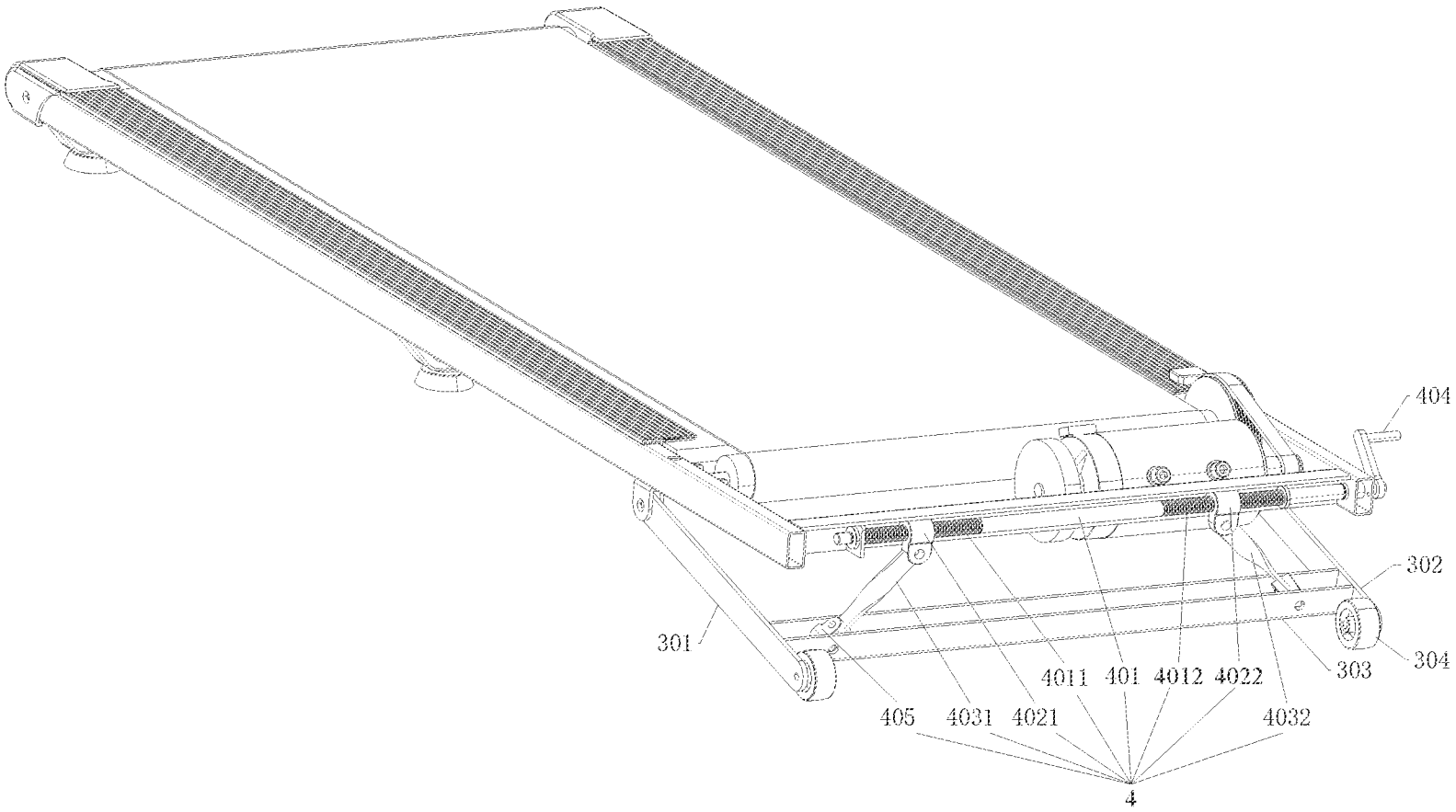
FIG. 2 is a schematic diagram of an overall structure from another perspective according to an embodiment of the present invention.

As shown in FIG. 1 and FIG. 2, according to an embodiment of the present invention, a treadmill capable of adjusting slope rising and falling by a screw rod is provided and includes a running platform 1 and a running frame 2. The running platform 1 is provided with a running belt 101, rollers 102 arranged at two ends of the running belt 101, and at least one running motor 103 for providing a driving force to at least one roller 102. The running frame 2 is a carrier of the running platform 1 and supports the running platform 1. The running frame 2 is arranged on a side surface of the running platform 1. A lifting frame 3 is arranged below the running frame 2. According to the present application, the slope of the treadmill is adjusted by the lifting frame 3. In this embodiment, the lifting frame 3 includes a side wall, and one end of the side arm is pivoted to the running frame 2. A driving mechanism 4 of the lifting frame 3 includes a lead screw 401, a screw sleeve 402 with teeth is mounted on the lead screw 401 in a matching manner, and the screw sleeve 402 can reciprocate on the lead screw 401 through the rotation of the lead screw 401. The driving mechanism 4 is connected to the lifting frame 3 through the supporting arm 403, and the lifting frame 3 is driven by the supporting arm 403 to move up and down so as to adjust the slope of the treadmill.

Specifically, in Embodiment 1, in this embodiment, the running frame 2 includes a first border 201 and a second border 202; the first border 201 and the second border 202 are arranged on two sides of the running platform 1, respectively; and the first border 201 and the second border 202 are arranged in parallel. The side wall of the lifting frame 3 is provided with a first side arm 301 and a second side arm 302, respectively; one end of the first side arm 301 is pivoted to the first border 201; and one end of the second side arm 302 is pivoted to the second border 202. The lead screw 401 is a bidirectional lead screw 401; the lead screw 401 is rotatably arranged between the first border 201 and the second border 202, and includes a forward thread section 4011 and a reverse thread section 4012; and the forward thread section 4011 is in sleeving connection with a first screw sleeve 4021, and the reverse thread section 4012 is in sleeving connection with a second screw sleeve 4022. The first screw sleeve 4021 is connected to the first side arm 301 through the first supporting arm 4031, and the second screw sleeve 4022 is connected to the second side arm 302 through the second supporting arm. A crank 404 is arranged at one end, close to the first border 201, of the lead screw 401, the lead screw 401 is rotated by shaking the crank 404, and the first screw sleeve 4021 and the second screw sleeve 4022 are driven to reciprocate on the lead screw 401, so that the first side arm 301 and the second side arm 302 are driven by the first supporting arm 4031 and the second supporting arm 4032 to adjust the slope of the treadmill. To prevent a force interference between the first supporting arm 4031 or the second supporting arm 4032 and the first side arm 301 or the second side arm 302 during movement, the first supporting arm 4031 and the second supporting arm 4032 are connected to the first side arm 301 and the second side arm 302 respectively through the rotating shaft base 405. The rotating shaft base 405 is rotatably connected to the side arm through the first rotating shaft, and is rotatably connected to the supporting arm 403 through the second rotating shaft. The first rotating shaft and the second rotating shaft are perpendicular to each other.

Embodiment 2, based on Embodiment 1, is different from Embodiment 1 in that a cross beam 303 is arranged between the first side arm 301 and the second side arm 302, and the cross beam 303 and the lead screw 401 are parallel to each other. One ends, away from the lead screw 401, of the first supporting arm 4031 and the second supporting arm 4032 are rotatably connected to the cross beam 303, and of course, may be connected to the cross beam 303 through the rotating shaft base 405.

Figure 3:
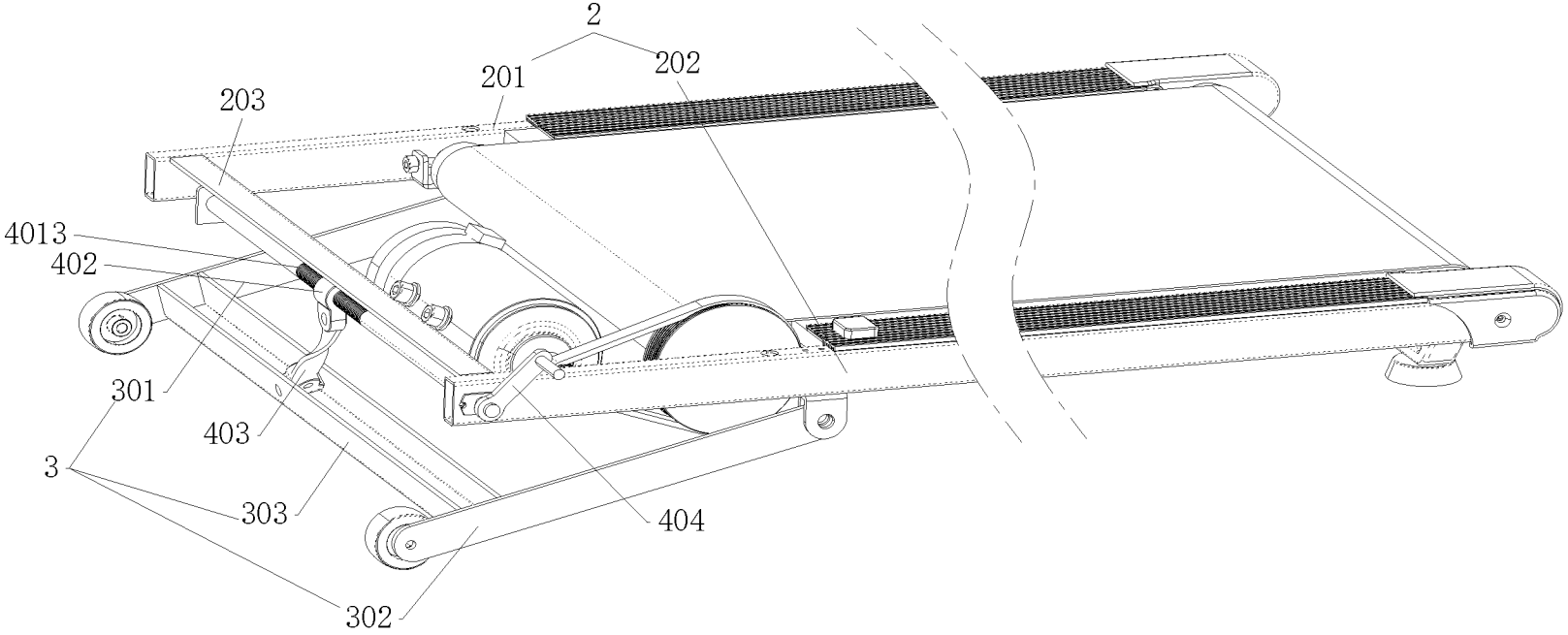
FIG. 3 is a structural schematic diagram of Embodiment 3 according to an embodiment of the present invention.

Embodiment 3, as shown in FIG. 3, based on Embodiment 1 and Embodiment 2, is different from the above embodiment in that only one supporting arm 403 is provided, the lead screw 401 is provided with a thread section 4013 in only one direction, and the lead screw 401 is in sleeving connection with only one screw sleeve 402. Preferably, one end of the supporting arm 403 is rotatably mounted in the middle of the cross beam 303 in Embodiment 2. Similarly, the thread section 4013 of the lead screw 401 is arranged in a middle area of the first border 201 and the second border 202.

Embodiment 4, not shown in the figure, based on the above embodiments, is different from the above embodiments in that the first side arm 301 and the second side arm 302 share a pivoting end with the running frame 2. Specifically, a cross frame 203 is arranged between the first border 201 and the second border 202, the cross frame is provided with a pivoting base, and the first side arm 301 and the second side arm 302 are jointly pivoted to the pivoting base. Of course, the first side arm 301 and the second side arm 302 may be combined into one single arm. Further, the cross beam 303 may be arranged at the tail end of the single arm, and the driving mechanism 4 is the same as the above embodiments.

In the above embodiments, a connection relationship between the driving mechanism 4 and the running frame 2 and a connection relationship between the driving mechanism and the lifting frame 3 may be changed adaptively.

For example, taking Embodiment 1 as an example, the lead screw 401 is rotatably arranged between the first side arm 301 and the second side arm 302, the free end of the first supporting arm 4031 is rotatably connected to the first border 201, and the free end of the second supporting arm 4032 is rotatably connected to the second border 202.

For another example, taking Embodiment 2 as an example, the lead screw 401 is rotatably arranged between the first side warm 301 and the second side arm 302; and correspondingly, a cross frame 203 is arranged between the first border 201 and the second border 202. In Embodiment 2, the cross beam 303 is provided. Here, the cross beam 303 can reduce a twisting force generated by the first side arm 301 and the second side arm 302 on the lead screw 401. The free end of the first supporting arm 4031 and the free end of the second supporting arm 4032 are rotatably connected to the cross frame 203.

In some embodiments, a moving wheel 304 is arranged at the end part of the side arm in the above embodiments, thereby facilitating the movement of the treadmill.

In some embodiments, several bottom feet 204 are arranged at the bottom of the running frame 2 in the above embodiments.

The foregoing is merely a preferred embodiment of the present invention and is not intended to limit the present invention which may be subject to various modifications and variations to those skilled in the art. Any modification, equivalent replacement, improvement, etc. made within the spirit and principles of the present invention should be included in the scope of protection of the present invention.

What is claimed is:

1. A treadmill capable of adjusting a slope rising and falling by a screw rod, the treadmill comprising a running platform:

a running frame, configured to bear the running platform;

a lifting frame, arranged below the running frame and comprising a side arm, one end of the side arm being pivoted to the running frame;

a driving mechanism, comprising a lead screw, the lead screw being in sleeving connection with a screw sleeve in a matching manner, and an outer side of the screw sleeve being rotatably connected to a supporting arm, wherein the driving mechanism is arranged between the running frame and the lifting frame, the screw sleeve is driven by rotating the lead screw to move on the lead screw, and the supporting arm is driven to drive the lifting frame to adjust the slope of the treadmill;

wherein a free end of the supporting arm is rotatably connected to a rotating shaft base in a non-slidable manner, and the rotating shaft base is rotatably connected to the lifting frame in a non-slidable manner.

2. The treadmill according to claim 1, wherein the running frame comprises a first border and a second border; and the side arm comprises a first side arm and a second side arm, one end of the first side arm being pivoted to the first border, and one end of the second side arm being pivoted to the second border.

3. The treadmill according to claim 2, wherein the lead screw comprises a forward thread section and a reverse thread section, the forward thread section is in sleeving connection with a first screw sleeve, and the reverse thread section is in sleeving connection with a second screw sleeve; and the supporting arm comprises a first supporting arm and a second supporting arm, the first supporting arm is pivoted to the first screw sleeve, and the second supporting arm is pivoted to the second screw sleeve.

4. The treadmill according to claim 3, wherein the lead screw is rotatably arranged between the first border and the second border.

5. The treadmill according to claim 4, wherein a free end of the first supporting arm is pivoted to the first side arm, and a free end of the second supporting arm is pivoted to the second side arm; or a cross beam is arranged between the first side arm and the second side arm, and the free end of the first supporting arm and the free end of the second supporting arm are both pivoted to the cross beam.

6. The treadmill according to claim 3, wherein the lead screw is rotatably arranged between the first side arm and the second side arm, the free end of the first supporting arm is pivoted to the first border, and the free end of the second supporting arm is pivoted to the second border.

7. The treadmill according to claim 2, wherein the lead screw comprises a thread section, the thread section is in sleeving connection with a screw sleeve, and the supporting arm is pivoted to the screw sleeve;

a cross beam is arranged between the first side arm and the second side arm, the lead screw is rotatably arranged between the first border and the second border, and the free end of the supporting arm is pivoted to the cross beam; or a cross frame is arranged between the first border and the second border, the lead screw is rotatably arranged between the first side arm and the second side arm, and the free end of the supporting arm is pivoted to the cross frame.

8. The treadmill according to claim 1, wherein a crank is arranged at one end of the lead screw; or/and the side arm is provided with a moving wheel; or/and several bottom feet are arranged at the bottom of the running frame.

* * * * *